US010497228B2

(12) United States Patent
Novick

(10) Patent No.: US 10,497,228 B2
(45) Date of Patent: Dec. 3, 2019

(54) PERFORATED TACTILE WARNING DEVICE

(71) Applicant: Porous Technologies, LLC, North Yarmouth, ME (US)

(72) Inventor: Gregg Novick, North Yarmouth, ME (US)

(73) Assignee: Porous Technologies, LLC, North Yarmouth, ME (US)

( * ) Notice: Subject to any disclaimer, the term of this patent is extended or adjusted under 35 U.S.C. 154(b) by 0 days.

(21) Appl. No.: 16/144,662

(22) Filed: Sep. 27, 2018

(65) Prior Publication Data

US 2019/0096200 A1 Mar. 28, 2019

Related U.S. Application Data

(60) Provisional application No. 62/563,668, filed on Sep. 27, 2017.

(51) Int. Cl.

| | |
|---|---|
| ***E01C 11/04*** | (2006.01) |
| ***E01C 5/06*** | (2006.01) |
| ***E01C 15/00*** | (2006.01) |
| ***E01C 11/24*** | (2006.01) |
| ***G08B 6/00*** | (2006.01) |

(52) U.S. Cl.

CPC ..... *G08B 6/00* (2013.01); *E01C 5/06* (2013.01); *E01C 11/04* (2013.01); *E01C 11/24* (2013.01); *E01C 15/00* (2013.01); *E01C 2201/02* (2013.01); *E01C 2201/20* (2013.01)

(58) Field of Classification Search

CPC ... G08B 6/00; E01C 5/06; E01C 11/04; E01C 11/24; E01C 2201/02; E01C 2201/20

See application file for complete search history.

(56) References Cited

U.S. PATENT DOCUMENTS

| | | | | | |
|---|---|---|---|---|---|
| 2,174,035 | A * | 9/1939 | Henderson | E01C 5/085 | 404/4 |
| 3,712,187 | A * | 1/1973 | Stelling | E01C 5/105 | 404/3 |
| 4,715,743 | A * | 12/1987 | Schmanski | A61H 3/066 | 404/9 |
| 5,217,319 | A * | 6/1993 | Klohn | A61H 3/066 | 340/407.1 |
| 5,271,690 | A * | 12/1993 | Fennessy, Sr. | A61H 3/066 | 404/9 |
| 5,320,790 | A * | 6/1994 | Lowe | A61H 3/066 | 249/127 |
| 5,775,835 | A * | 7/1998 | Szekely | E01C 5/20 | 104/30 |

(Continued)

*Primary Examiner* — Abigail A Risic

(74) *Attorney, Agent, or Firm* — Tredecim LLC; Sean L. Sweeney; Taylor A. Noonan

(57) ABSTRACT

Described herein is a perforated tactile warning device comprising a tactile panel and a porous concrete slab. The tactile panel includes perforations to allow water to pass through the tactile panel and the tactile panel is secured to the porous concrete slab such that a space exists between the tactile panel and the porous concrete slab. Further, the porous concrete slab may include channels to collect water and direct water within the porous concrete slab. Further still, where the concrete slab includes channels, the concrete slab may be nonporous and may utilize drainage holes to permit water to pass through an otherwise nonporous concrete substrate.

16 Claims, 5 Drawing Sheets

(56) References Cited

U.S. PATENT DOCUMENTS 6,450,728 B1 * 9/2002 Grahmbeek ..... E01F 9/50 404/15
6,718,714 B1 * 4/2004 Montgomery, Sr. ..... F24D 13/022 52/392
6,939,078 B1 * 9/2005 Anderson ..... A61H 3/066 404/73
6,951,435 B1 * 10/2005 Fennessy, Sr. ..... B28B 7/0064 249/188
7,000,361 B1 * 2/2006 Merriman ..... E01C 5/00 404/75
7,001,103 B2 2/2006 Sippola
7,189,025 B1 * 3/2007 Greer ..... E01C 5/20 404/19
7,735,278 B2 * 6/2010 Becker ..... B32B 3/04 52/126.4
7,740,413 B1 * 6/2010 Grayson ..... A61F 9/08 404/12
7,753,616 B2 * 7/2010 Greer ..... E01F 9/512 404/12
7,779,581 B2 * 8/2010 Flaherty ..... E01C 5/20 116/205
7,779,591 B2 * 8/2010 Becker ..... E01C 5/003 52/125.4
7,827,928 B2 * 11/2010 Shaw ..... E01C 5/20 116/205
7,992,360 B2 * 8/2011 Driscoll ..... E01C 5/001 404/15
8,353,640 B2 * 1/2013 Sawyer ..... E01C 11/225 404/4
8,439,596 B1 * 5/2013 Dvoracek ..... A61H 3/066 404/19
8,662,788 B2 * 3/2014 Sippola ..... A61H 3/066 404/134
8,920,066 B1 * 12/2014 Meyers ..... E01C 5/20 404/18
8,967,904 B1 * 3/2015 Bub ..... A61H 3/066 404/19
9,033,612 B2 * 5/2015 Szekely ..... A61H 3/066 404/113
9,311,831 B2 * 4/2016 Henshue ..... G09F 19/228
9,361,816 B2 * 6/2016 Henshue ..... G09F 19/228
9,365,984 B2 6/2016 Flaherty et al.
9,408,772 B2 * 8/2016 Bub ..... A61H 3/066
9,605,388 B2 * 3/2017 Szekely ..... E01C 5/00
9,895,284 B2 * 2/2018 Henshue ..... A61H 3/066
9,949,886 B2 * 4/2018 Henshue ..... A61H 3/061
2003/0231929 A1 * 12/2003 Lee ..... E01C 5/005 404/34
2004/0042850 A1 * 3/2004 Provenzano, III ..... A61H 3/066 404/34
2004/0067336 A1 * 4/2004 Munroe, II ..... E01F 9/50 428/131
2004/0200173 A1 * 10/2004 Drake ..... E01C 7/147 52/514.5
2006/0245827 A1 * 11/2006 Rydin ..... A61H 3/066 404/9
2007/0092335 A1 * 4/2007 Wehmeyer ..... A61H 3/066 404/19
2008/0008526 A1 * 1/2008 Boghossian ..... A61H 3/066 404/71
2008/0236064 A1 * 10/2008 Sippola ..... A61H 3/066 52/177
2008/0280097 A1 * 11/2008 Flaherty ..... E01C 5/20 428/131
2010/0129150 A1 * 5/2010 Sippola ..... A61H 3/066 404/42
2010/0229783 A1 * 9/2010 Szekely ..... E01C 5/00 116/202
2012/0275858 A1 * 11/2012 Szekely ..... A61H 3/066 404/22
2013/0167439 A1 * 7/2013 Herrberg ..... E01C 15/00 47/58.1 R
2014/0286702 A1 * 9/2014 Szekely ..... E01C 9/00 404/9
2015/0167260 A1 * 6/2015 Siqueiros ..... E01C 5/06 404/73
2017/0174000 A1 * 6/2017 Dagrossa ..... B60B 39/12

* cited by examiner

PERFORATED TACTILE WARNING DEVICE

CROSS-REFERENCE TO RELATED APPLICATION

This application claims the benefit of U.S. Provisional Patent Application 62/563,668, filed Sep. 27, 2017, the disclosure of which is herein incorporated by reference.

BACKGROUND

1. Field of the Invention

The invention relates to pedestrian warning devices, particularly those that are incorporated into roadway corners or sidewalks for pedestrian use.

2. Discussion of Background Information

Sidewalks are well known structures that provide a walking surface for pedestrians, and that are frequently used on the sides of roads, parking lots, and other similar areas where pedestrians and vehicles are both routinely present. Such sidewalks are typically made from a form of pavement and are typically anywhere from 4 to 8 inches above the road surface.

To make sidewalks safer, particularly for users with disabilities, ramps are used to create a sloped transition from the sidewalk to the road surface. These ramps and associated landings are subject to numerous government regulations, particularly under the Americans with Disabilities Act, that are intended to ensure that the surface is safe for use by pedestrians and disabled persons.

In general, these ramps or landings have a concrete base, similar to the sidewalk itself, that is covered with a tactile panel, such as the Universal Radius Tactile Warning Surface Product (U.S. Pat. No. 9,365,985 B2), which is a glass and carbon composite panel that is enhanced with fiberglass truncated domes. Traditionally, tactile panels are either cast-in-place or surface applied.

Although cast-in-place tactile panels are easy to install in fresh concrete, they are difficult and costly to replace because once the concrete is set, the underlying substrate must be at least partially destroyed in order to remove and replace the tactile panel. One variation of cast-in-place tactile panels features spaced honeycomb-like lower walls. However, because of the nature of the honeycomb, air can become trapped between the lower walls, creating areas that lack support from the underlying substrate. This trapped air can result in a lack of support that can lead to fatigue, and cracking failure of the tactile panel due to repetitive and heavy loading.

Surface applied tactile panels are tactile panels applied to a finished substrate. Surface applied tactile panels are typically mechanically fastened and adhered to the underlying substrate. In addition, in order to compensate for irregularities in the substrate and minimize water intrusion that would otherwise damage the tactile panel, the surface applied tactile panels require additional caulking around the perimeter. Because surface applied tactile panels are mechanically fastened, they are easier and cheaper to remove than cast-in-place tactile panels. Once the fasteners are removed, the panel is heated to break the adhesive bond then stripped away from the underlying substrate. As a result, the underlying substrate remains intact, reducing the cost and time associated with replacing the tactile panel.

Although the surface applied tactile panel improves upon the cast-in-place tactile panel, both cast-in-place and surface applied tactile panels suffer from similar shortcomings. Both fail to remove the potential for air and water infiltration, which in turn compromises the structural integrity and functionality of the tactile panels.

These shortcomings are particularly problematic because the intersections of pedestrian ramps and sidewalks and street gutters are often locations where it is difficult to drain away standing water that remains after a rain or snow-melt event. Frequently there is insufficient pitch in these areas to provide positive drainage relief and puddles and ice may form resulting in hazards to pedestrians. If water is able to enter around the tactile panel at such a location or between the panel and the concrete slab, over time it will expand or contract, thus causing numerous problems to the long-term safety and stability of the ramp. To address these issues, ramp manufacturers go to great lengths to create water-tight or water-resistant tactile panels to prevent water from entering the ramp system. However, with a water tight ramp, pools of standing water may form at the base of the ramp during times of rain or melting snow or ice, causing puddles to form in the roadways and often back up the ramp, thus introducing a new hazard.

Porous concrete, also known as porous pavement, is distinguishable from traditional or non-porous concrete due to its high porosity, which allows for stormwater to infiltrate back into the ground naturally by passing directly through the concrete. Porous concrete has the ability to reduce pavement runoff and prevent pooling in areas that lack adequate drainage. As a result, porous concrete slabs allow water, whether the water comes from rain, melting snow or ice, or general road cleaning activities, to drain through the porous concrete and infiltrate back into the ground. However, current tactile panels do not allow water flow, thereby negating the benefits of using porous concrete as an underlying substrate.

What is needed, therefore, is a tactile warning device that is able to reduce the pooling or collection of water on or around the ramp and does not suffer structural degradation due to air and water infiltration.

SUMMARY OF THE INVENTION

The present invention solves the problems associated with tactile warning devices by providing tactile warning devices that effectively handle air and water infiltration.

The present invention is directed to a tactile warning device that effectively handles air and water infiltration. The perforated tactile warning device comprises a porous concrete slab and a tactile panel comprising a plurality of domes and a plurality of perforations, wherein the tactile panel is secured to the porous concrete slab via a plurality of anchors such that a space is created between a substantial portion of the tactile panel and the concrete slab.

The present invention is also directed to a tactile warning device that utilizes channels to effectively handle air and water infiltration. The perforated tactile warning device comprises a porous concrete slab having one or more channels and a tactile panel comprising a plurality of domes and a plurality of perforations, wherein the tactile panel is secured to the porous concrete slab via a plurality of anchors.

The present invention is also directed to a tactile warning device that utilizes nonporous concrete to effectively handle air and water infiltration. The perforated tactile warning device comprises a nonporous concrete slab having one or more channels and one or more drainage holes and a tactile panel comprising a plurality of domes and a plurality of perforations, wherein the tactile panel is secured to the nonporous concrete slab via a plurality of anchors.

BRIEF DESCRIPTION OF THE DRAWINGS

These and other features, aspects and advantages of the present invention will become better understood with reference to the following description, appended claims, and accompanying drawings where:

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
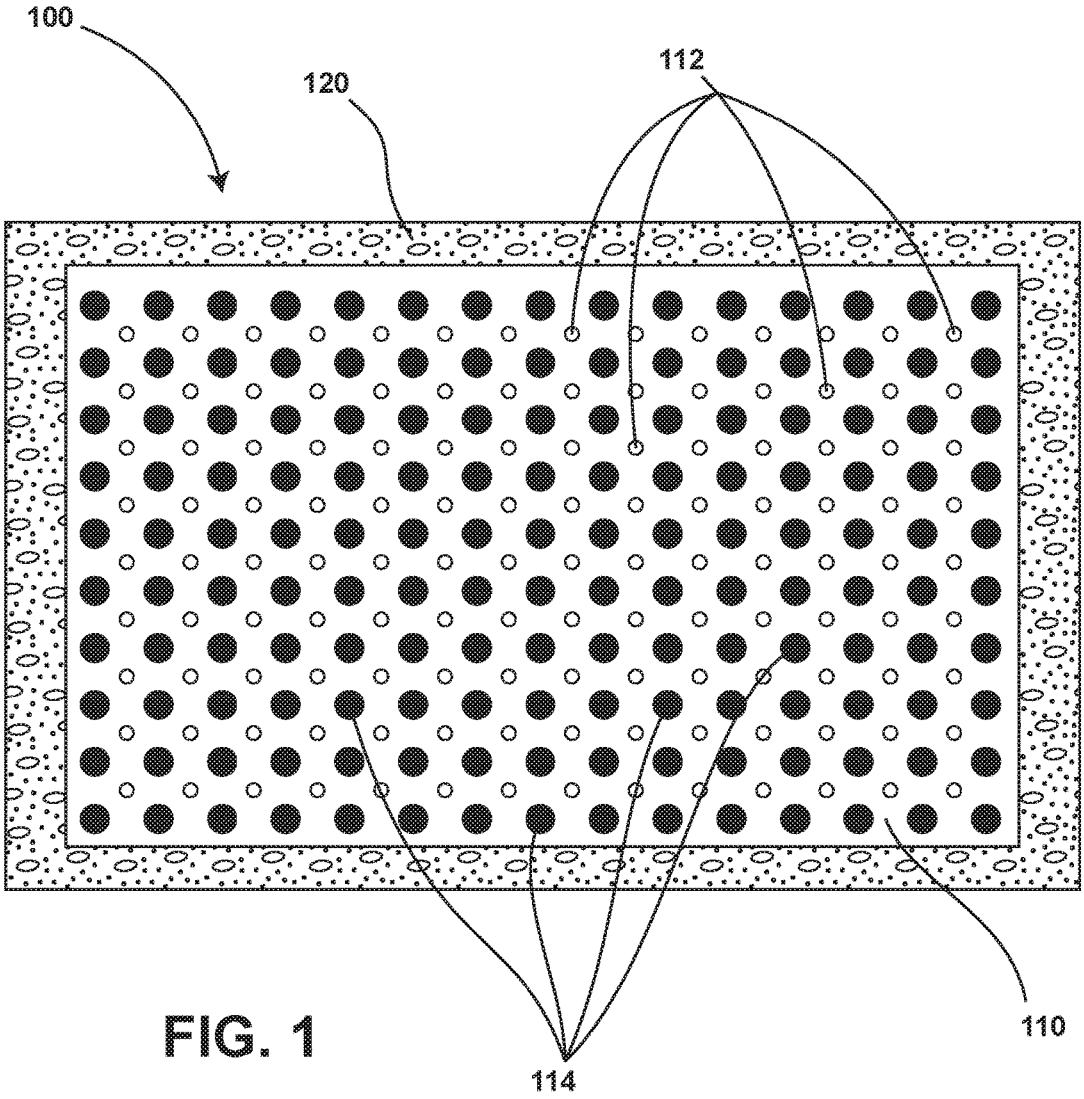
FIG. 1 is a top view of a first embodiment of a perforated tactile warning device of the present invention.
Figure 2:
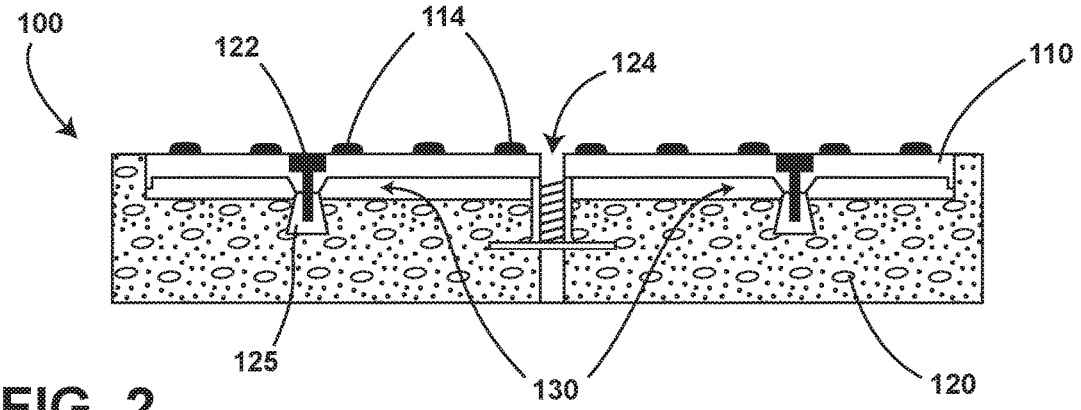
FIG. 2 is a cross section view of an embodiment of a perforated tactile warning device of the present invention.
Figure 3:
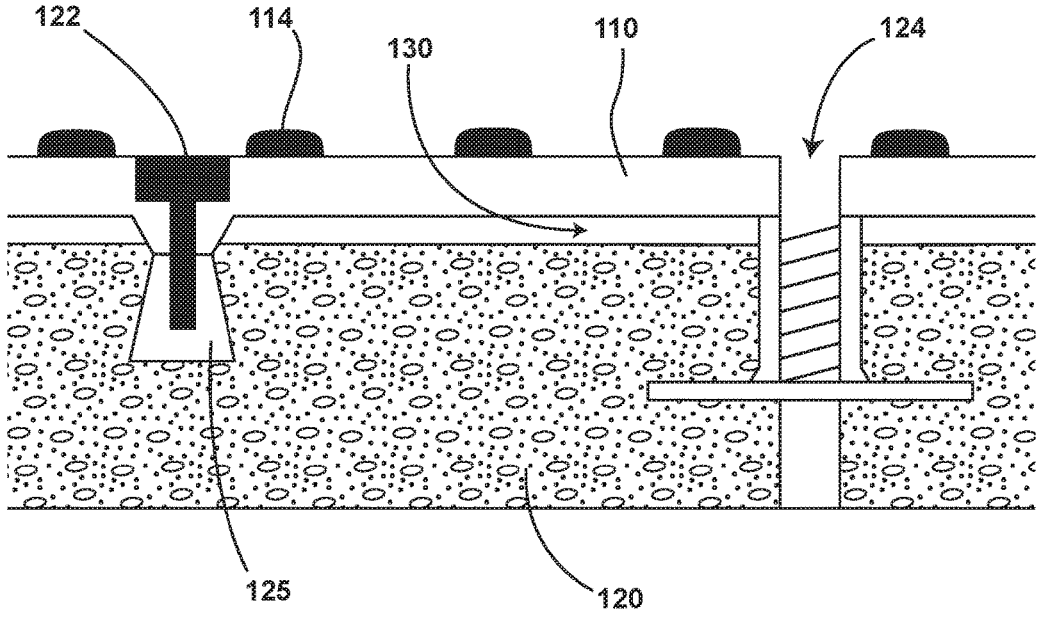
FIG. 3 is a detail cross section view of an embodiment of a perforated tactile warning device of the present invention.

FIGS. 1-3 depict a first embodiment of the perforated tactile warning device 100 of the present invention. The perforated tactile warning device 100 includes a tactile panel 110 having a plurality of perforations 112 and a porous concrete slab 120. The tactile panel 110 has a plurality of raised points, or domes 114 that are uniformly positioned across the tactile panel 110 in order to provide a slip-resistant surface that also acts as a warning system for disabled pedestrians. The tactile panel 110 is secured to the porous concrete slab 120 by a plurality of anchors 122. The anchors 122 are secured into anchor points 125 and support the tactile panel 110 between about 0.125 inches and about 0.5 inches above the porous concrete slab 120, creating a space 130 between the tactile panel 110 and the porous concrete slab 120.

The space 130 solves several of the problems inherent in prior art devices. Infiltration of air and water both result in the degradation of existing devices through erosion of both the tactile warning panel and the underlying concrete substrate. The presence of space in these existing devices is eliminated in order to avoid air and water infiltration that would exacerbate an already significant weakness in the system. Air and water infiltration not only increase the degradation rate of the existing devices, resulting in rusted, warped and cracked tactile panels, but attempting to avoid air and water infiltration creates new hazards such as pooling around the warning devices. In colder climates, when pooling occurs around a warning device, the pooled water may freeze, creating a further hazard. In contrast, the combination of the space 130 and the porous concrete slab 120 in the perforated tactile warning device 100 addresses both of these problems by serving as a reservoir for the water that flows freely through the perforations 112 and also enabling effective management of the water via percolation through the underlying porous concrete slab 120. This passage of water through the perforated tactile warning device 100 is in stark contrast to prior devices and allows the perforated tactile warning device 100 to withstand stormwater runoff, melting and other water-related concerns, without compromising the structural integrity of the perforated tactile warning device 100.

Ideally, the perforations 112 are holes with diameters between about 0.125 inches and about 0.5 inches, preferably about 0.1875 inches. The perforations 112 are sized large enough to allow water to flow through the tactile panel 110, yet not so large as to compromise the structural integrity of the tactile panel 110. The size and number of the perforations 112 can be adjusted to ensure that the perforated tactile warning device 100 is capable of handling the anticipated volume of stormwater.

The perforations 112 may be evenly distributed across the tactile panel 110 so as to allow water to pass through the tactile panel 110 regardless of where the water contacts the tactile panel 110. For example, the perforations 112 may be centered between the domes 114 as shown in FIG. 1. Alternatively, the perforations 112 may be grouped along the edges of the tactile panel 110. For example, in some installations it may be advantageous to group the perforations 112 near the lower edge of the tactile panel 110 such that as water flows down the ramp it is directed toward the perforations 112 and consequently through the tactile panel 110 and into the porous concrete slab 120.

While the porous concrete slab 120 is at least the size of the tactile panel 110, the porous concrete slab 120 may also be larger than the tactile panel 110 in one or more dimensions, creating a border of porous concrete in the perforated tactile warning device 100. In addition, the porous concrete slab 120 may include one or more lifting points 124 as known in the art in order to allow the perforated tactile warning device 100 to be lifted, removed and replaced as necessary. Where lifting points 124 are utilized within the porous concrete slab 120, there will be corresponding holes in the tactile panel 110 to allow access to the lifting points 124.

Figure 4:
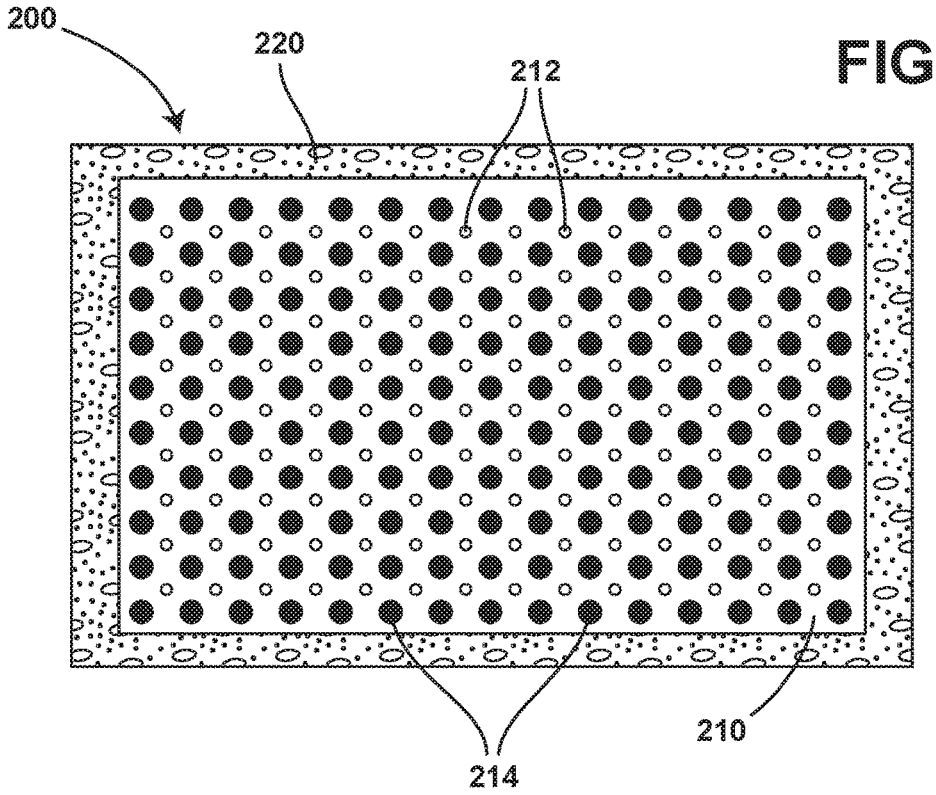
FIG. 4 is a top view of a second embodiment of a perforated tactile warning device of the present invention.
Figure 5:
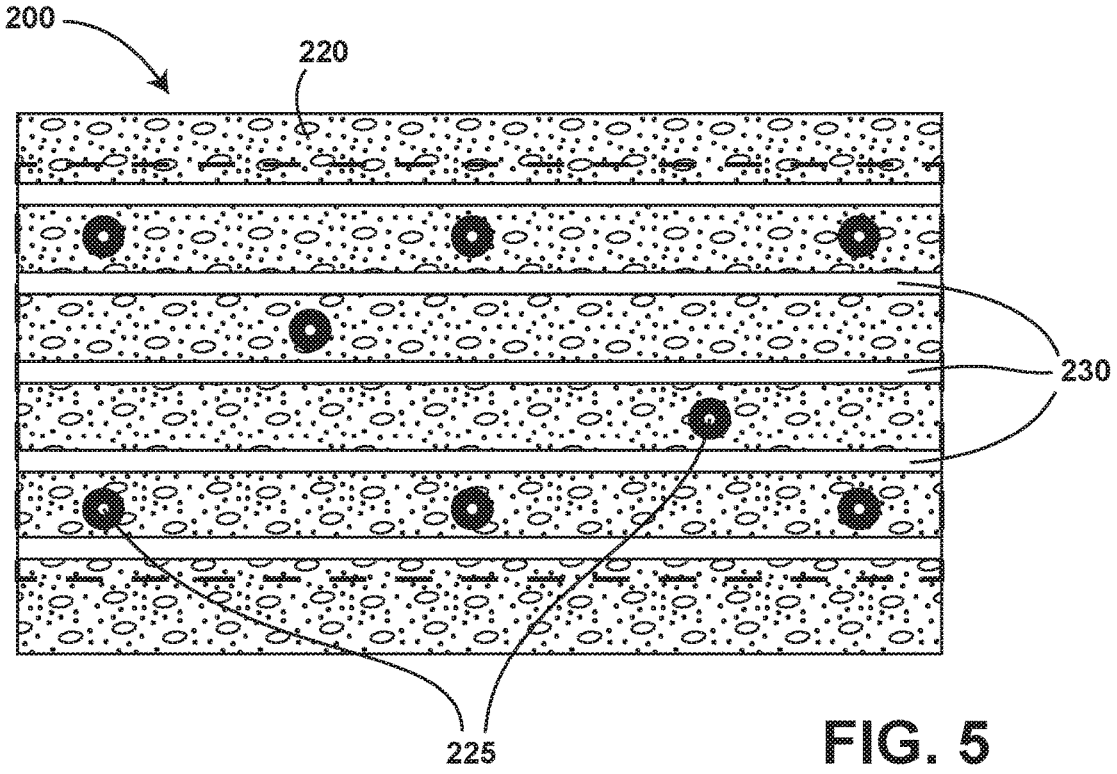
FIG. 5 is a top view of a second embodiment of a perforated tactile warning device of the present invention.
Figure 6:
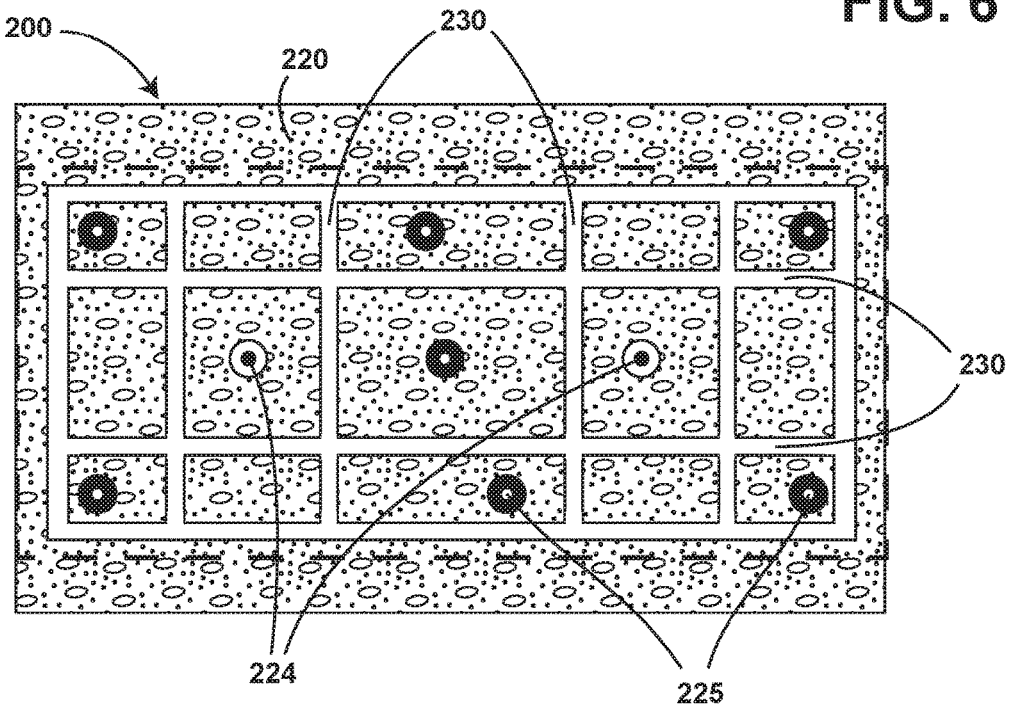
FIG. 6 is a top view of a second embodiment of a perforated tactile warning device of the present invention.

Turning to FIGS. 4-6, a second embodiment of the perforated tactile warning device 200 is depicted. In this particular embodiment, the tactile panel 210 is secured to a porous concrete slab 220 that includes one or more channels 230. FIGS. 5 and 6 depict the perforated tactile warning device 200 with the tactile panel 210 removed to reveal the channels 230 in the porous concrete slab 220. In addition, the dashed line depicted in FIGS. 5 and 6 represents the location of the removed tactile panel 210. The channels 230 allow the tactile panel 210 to be secured to the porous concrete slab 220 via one or more anchor points 225, with limited space between the tactile panel 210 and the porous concrete slab 220. In some embodiments, the space between the tactile panel 210 and the porous concrete slab 220 can be eliminated such that a substantial portion of the tactile panel 210 is in direct contact with the porous concrete slab 220.

The channels 230 in the porous concrete slab 220 may be oriented and sized based on the expected amount of water infiltration and the structural requirements of the porous concrete slab 220. For example, the channels 230 may be arranged substantially parallel to one another as depicted in FIG. 5, or in a grid pattern as depicted in FIG. 6. To allow the water to drain through the tactile panel 210, the tactile panel 210 includes perforations 212. The perforations 212 may be arranged about the tactile panel 210 in a manner that positions the perforations 212 substantially above the one or more channels 230 in the porous concrete slab 220, such that surface water may drain through the perforations 212, collect in the channels 230, and then percolate through the porous concrete slab 220.

While the porous concrete slab 220 is at least the size of the tactile panel 210, the porous concrete slab 220 may also be larger than the tactile panel 210 in one or more dimensions, creating a border of porous concrete in the perforated tactile warning device 200. In addition, the porous concrete slab 220 may include one or more lifting points 224 as known in the art in order to allow the perforated tactile warning device 200 to be lifted, removed and replaced as necessary. Where lifting points 224 are utilized within the porous concrete slab 220, there will be corresponding holes in the tactile panel 210 to allow access to the lifting points 224.

Figure 7:
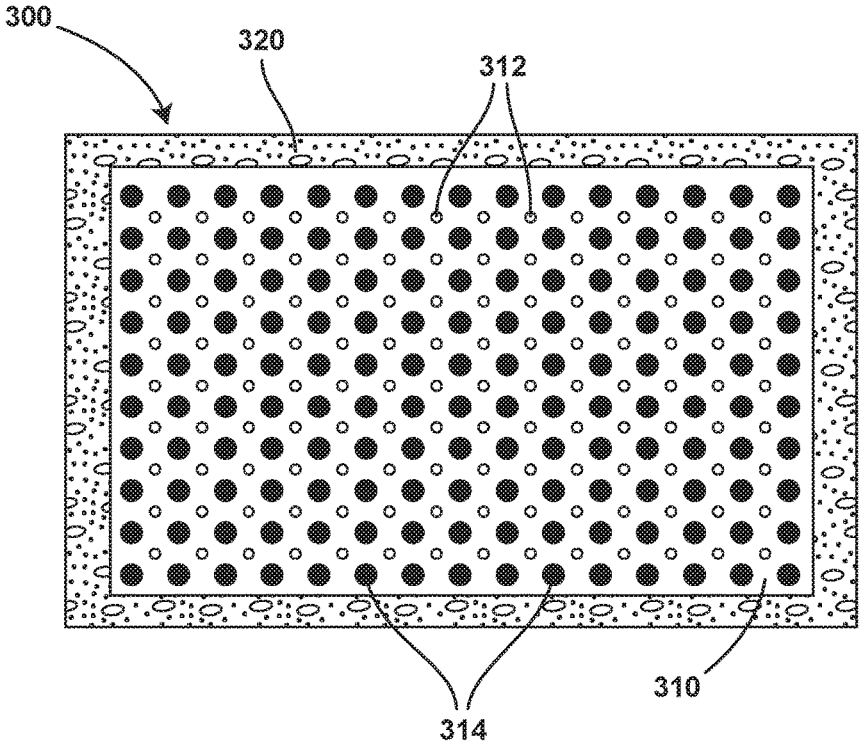
FIG. 7 is a top view of a third embodiment of a perforated tactile warning device of the present invention.
Figure 8:
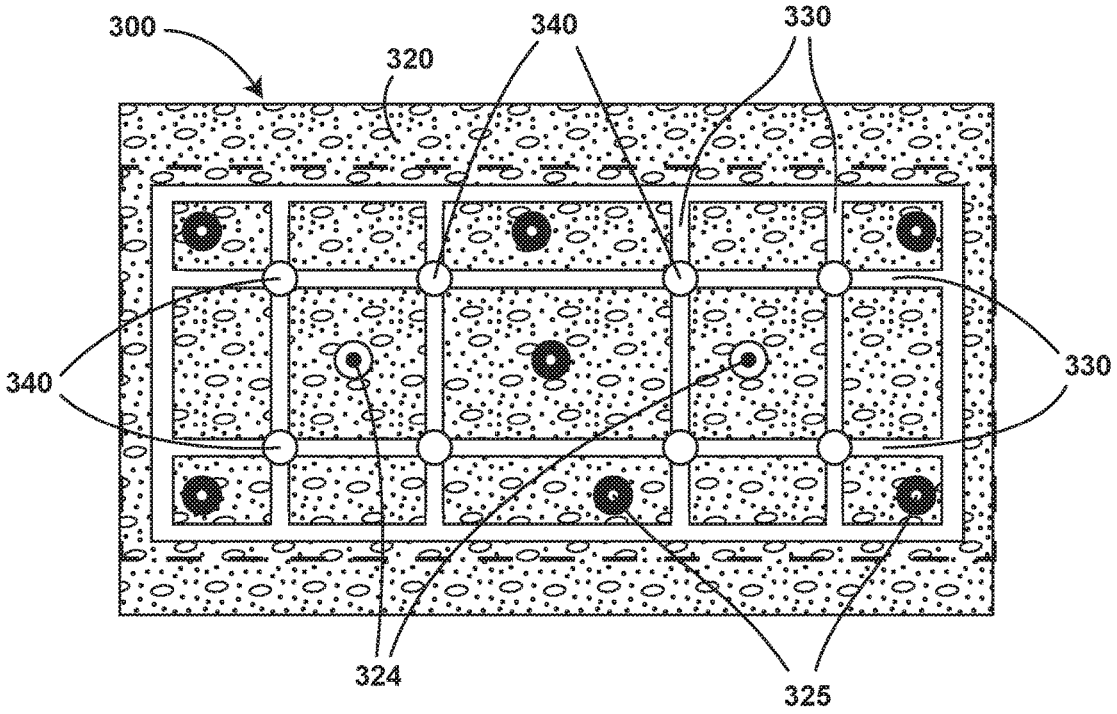
FIG. 8 is a top view of a third embodiment of a perforated tactile warning device of the present invention.

Turning to FIGS. 7 and 8, a third embodiment of the perforated tactile warning device 300 is depicted. In this particular embodiment, the tactile panel 310 is secured to a nonporous concrete slab 320 that includes one or more channels 330 and one or more drainage holes 340. FIG. 8 depicts the perforated tactile warning device 300 with the tactile panel 310 removed to reveal the channels 330 and the drainage holes 340 in the nonporous concrete slab 320. In addition, the dashed line depicted in FIG. 8 represents the location of the removed tactile panel 310. In order to allow the water in the channels 330 to permeate the nonporous concrete slab 320, the drainage holes 340 are located within the channels 330 and extend through the nonporous concrete slab 320. In some embodiments, the channels 330 may be sloped such that gravity causes water to be directed to the drainage holes 340. The channels 330 and the drainage holes 340 may be oriented and sized based on the expected amount of water infiltration and the structural requirements of the nonporous concrete slab 320. For example, as depicted in FIG. 8, the channels 330 may be arranged in a grid pattern, with the drainage holes 340 located at the intersection of one or more channels 330. Alternatively, the channels 330 may be arranged substantially parallel to one another, with drainage holes 340 positioned within the channels 330.

The presence of the channels 330 and drainage holes 340 allows the tactile panel 310 to be secured to a nonporous concrete slab 320 via one or more anchor points 325, with limited space between the tactile panel 310 and the nonporous concrete slab 320. In some embodiments, the space between the tactile panel 310 and the nonporous concrete slab 320 can be eliminated such that a substantial portion of the tactile panel 310 is in direct contact with the nonporous concrete slab 320. To allow the water to drain through the tactile panel 310, the tactile panel 310 includes perforations 312. The perforations 312 may be arranged about the tactile panel 310 in a manner that positions the perforations 312 substantially above the one or more channels 330 in the nonporous concrete slab 320, such that surface water may drain through the perforations 312, collect in the channels 330, and then pass through the nonporous concrete slab 320 via the drainage holes 340.

While the nonporous concrete slab 320 is at least the size of the tactile panel 310, the nonporous concrete slab 320 may also be larger than the tactile panel 310 in one or more dimensions, creating a border of nonporous concrete in the perforated tactile warning device 300. Alternatively, while the perforated tactile warning device 300 may utilize a nonporous concrete slab 320, porous concrete may be poured adjacent to the perforated tactile warning device 300 to increase drainage capacity.

Similar to the porous concrete slabs 120, 220 detailed above, the nonporous concrete slab 320 may include one or more lifting points 324 in order to allow the perforated tactile warning device 300 to be lifted, removed and replaced as necessary. Where lifting points 324 are utilized within the nonporous concrete slab 320, there will be corresponding holes in the tactile panel 310 to allow access to the lifting points 324.

It is noted that the foregoing examples have been provided merely for the purpose of explanation and are in no way to be construed as limiting of the present invention. While the present invention has been described with reference to exemplary embodiments, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A perforated tactile warning device comprising:

a porous concrete slab having a plurality of channels; and a tactile panel comprising a plurality of domes, a plurality of anchor holes and a plurality of perforations, wherein the tactile panel is secured to the porous concrete slab via a plurality of anchors, each anchor passing through the tactile panel via one of the anchor holes.

2. The perforated tactile warning device of claim 1 wherein the plurality of perforations are positioned substantially above the plurality of channels.

3. The perforated tactile warning device of claim 1 wherein the plurality of channels are arranged substantially parallel.

4. The perforated tactile warning device of claim 1 wherein the plurality of channels are arranged in a grid pattern.

5. The perforated tactile warning device of claim 1 wherein the porous concrete slab includes one or more lifting points.

6. The perforated tactile warning device of claim 1 wherein the porous concrete slab extends beyond the tactile panel to create a border of porous concrete.

7. The perforated tactile warning device of claim 1 wherein a substantial portion of the tactile panel is in direct contact with the porous concrete slab.

8. A perforated tactile warning device comprising:

a nonporous concrete slab having a plurality of channels and one or more drainage holes; and a tactile panel comprising a plurality of domes, a plurality of anchor holes and a plurality of perforations, wherein the tactile panel is secured to the nonporous concrete slab via a plurality of anchors, each anchor passing through the tactile panel via one of the anchor holes.

9. The perforated tactile warning device of claim 8 wherein the one or more drainage holes are positioned within the plurality of channels.

10. The perforated tactile warning device of claim 8 wherein the plurality of perforations are positioned substantially above the plurality of channels.

11. The perforated tactile warning device of claim 8 wherein the plurality of channels are arranged substantially parallel.

12. The perforated tactile warning device of claim 11 wherein at least one of the one or more drainage holes are located within the plurality of channels.

13. The perforated tactile warning device of claim 8 wherein the plurality of channels are arranged in a grid pattern.

14. The perforated tactile warning device of claim 13 wherein at least one of the one or more drainage holes is located at the intersection of two channels.

15. The perforated tactile warning device of claim 8 wherein the nonporous concrete slab includes one or more lifting points.

16. The perforated tactile warning device of claim 8 wherein a substantial portion of the tactile panel is in direct contact with the nonporous concrete slab.

* * * * *